US005111878A

United States Patent [19]

Kadle

[11] Patent Number: 5,111,878

[45] Date of Patent: May 12, 1992

[54] U-FLOW HEAT EXCHANGER TUBING WITH IMPROVED FLUID FLOW DISTRIBUTION

[75] Inventor: Prasad S. Kadle, Getzville, N.Y.

[73] Assignee: General Motors Corporation, Detroit, Mich.

[21] Appl. No.: 724,033

[22] Filed: Jul. 1, 1991

[51] Int. Cl.[5] ..... F28D 1/03

[52] U.S. Cl. ..... 165/176; 165/153; 165/174

[58] Field of Search ..... 165/152, 153, 174, 176

[56] References Cited

U.S. PATENT DOCUMENTS 4,781,248 11/1988 Pfeiffer ..... 165/167
4,800,954 1/1989 Noguchi et al. ..... 165/153
4,915,163 4/1990 Matsunaga et al. ..... 165/153

*Primary Examiner*—Allen J. Flanigan

*Attorney, Agent, or Firm*—Ronald L. Phillips

[57] ABSTRACT

An evaporator for an automotive air conditioner having a plurality of U-flow tubes therein arranged side by side so that spaces are provided for air centers secured between the sidewalls of the tubes. Each tube is formed from a pair of identical plates that have a centralized divider rib that separates the tubes into separate side flow passages joined by a lower interconnecting cross-over passage. The tubes have a plurality of flow ribs indented and joined in a predetermined pattern therein to form discrete fluid flow sections within each tube. The ribs are interconnected in such a manner that the sections effectively direct and tailor the flow of the heat exchanger fluid to a lower and intermediate section of the tube at the turning of the flow from one section to another to reduce, or substantially eliminate, dry out areas in each tube, thereby increasing heat exchanger tube and evaporator efficiency.

4 Claims, 4 Drawing Sheets

U-FLOW HEAT EXCHANGER TUBING WITH IMPROVED FLUID FLOW DISTRIBUTION

FIELD OF THE INVENTION

This invention relates to new and improved U-flow heat exchanger tubing having a divider rib defining discrete internal flow passages ribbed to effectively provide twisting fluid flow paths through each passage for improving the heat transfer efficiency and more particularly to such tubing in which the side flow passages are interconnected by a crossover passage having a rib design that directs and spreads the flow of heat exchanger fluid throughout the crossover passage to effectively eliminate dry out areas in the tubing and thereby increase the efficiency of the tubing and the heat exchanger.

BACKGROUND OF THE INVENTION

In a heat exchanger employing U-flow evaporator tubes, the refrigerant changes from a liquid to a gaseous phase as it flows from the inlet side to the outlet side of each tube. However, as the refrigerant flows around the bottom, or top corners, depending on evaporator orientation, the flow stays closer to the inside and near the separating rib. This causes liquid refrigerant starvation with only vapor present in the corners of the tubes which accordingly have low heat conversion capacity. This can be readily observed in thermographs as hot spots in an evaporator which are detrimental to heat transfer performance of the evaporator.

In the heat exchangers disclosed in my copending application, U.S. Ser. No. 677,193, filed Mar. 29, 1991, for HIGH EFFICIENCY HEAT EXCHANGER WITH DIVIDER RIB LEAK PATHS, now U.S. Pat. No. 5,062,477, issued Nov. 5, 1991, assigned to the assignee of this invention and hereby incorporated by reference, construction is provided to improve heat exchanger performance by minimizing dry out areas. More particularly, in my copending application, spaced leak paths are formed in the centralized divider rib of U-flow type tubes of an evaporator for an air conditioner system to ensure that some of the liquid refrigerant would be short circuited from the inlet to the outlet or vapor side of the tube so that localized dry out and hot spots would be reduced or eliminated and heat exchanger efficiency would be thereby improved.

The heat exchanger of this invention is of the general category of that disclosed in my copending application, and has a plurality of flattened tubes which are operatively joined at their upper tank ends to form a core for the passage of volatile heat exchanger fluid therethrough from an intake pipe to an outlet. Each of these tubes are formed from a pair of plates having a solid divider rib going down the center separating the tubes into discrete side flow passages, generally referenced as the liquid side and the vapor side. The flow passages have indented rib patterns therein to vary the flow path through the tubes to enhance the heat exchanger efficiency. The side flow passages are generally interconnected at the bottom end of the tube by a crossover passage which has specialized refrigeration fluid director ribs, as will be further explained.

More particularly, this invention prevents dry out from happening with a specialized rib pattern in the crossover passage which directs refrigerant flow to the region where liquid refrigerant starvation would normally occur. This variation is used on only one side of the evaporator plate because an identical plate is used as the other half of the refrigerant flow tube by interfacing and joining a pair of plates together. Accordingly, the ribs on the overlapping plate have a specialized pattern of ribs designed to distribute and direct liquid refrigerant to the corners of the crossover passage of these tubes. As indicated above, only one set of tooling is required since both halves of the evaporator tubes are identical.

This rib arrangement can be tailored to match any type of rib pattern prevalent in the rest of the tube. The flow distributing and directing ribs are preferably staggered oblong bumps. However, these could be of other suitable shape such as parallel ribs, oval bumps or round bumps. etc.

In view of the above, this invention provides a new and improved evaporator tube which features unique construction that eliminates or sharply reduces local dry out areas in an U-flow evaporator tubing by improving control of the change in phase from a liquid to a gas as the heat exchanger fluid courses through the heat exchanger tubing from the inlet side to the outlet side thereof. More particularly, by feeding increased quantities of heat exchanger liquid or by feeding a mixture containing higher quantity of liquid than vapor to the flow corners of the crossover passage of each tube, dry out areas otherwise normally occurring will be significantly reduced and heat transfer efficiency will be improved.

Accordingly, it is a feature, object and advantage of this invention to provide a new and improved tube for use in a heat exchanger core in which heat exchanger fluid flow paths are provided from the heat exchanger inlet of the tubes to the outlet thereof so that increased quantities of volatile liquid can be fed to the flow corners of the tube so as to be available for vaporization in otherwise dry out areas to thereby increase the heat transfer efficiency of the heat exchanger tubing.

In a preferred embodiment of the present invention, dry out can be effectively eliminated by providing a highly specialized flow directing rib pattern in an interconnecting crossover passage which enhances heat exchanger fluid flow between discrete side flow sections of the tubing. These patterns are arranged to keep the lower part, or corner parts, of each tube adequately fed with liquid heat exchanger fluid so that all portions of the tubing are effectively used to absorb the heat energy of the air blowing past the tubes to change the phase of the heat exchanger fluid from liquid into gas.

The tube pass of this invention provides a highly efficient heat transfer design by providing a first tube section with a plurality of extending rows of ribs side-by-side in first and second side passages or zones to provide a tortuous fluid flow path for high efficiency heat transfer operation. This tube pass further provides a crossover zone interconnecting the first and passages second zones located at the end of the tube pass with an overlapping rib configuration which is angled to direct sufficient liquid from the first zone throughout the crossover zone so that the heat absorption and efficiency is enhanced and dry out areas are reduced or eliminated therein. Moreover, this arrangement provides excellent fluid distribution across the width of the tube pass and within the tube for efficient use of the extensive heat transfer area thus provided.

Further advantages, features and objects of the present invention will become more apparent from the following description and drawings in which.

DETAILED DESCRIPTION OF THE DRAWINGS

Figure 1:
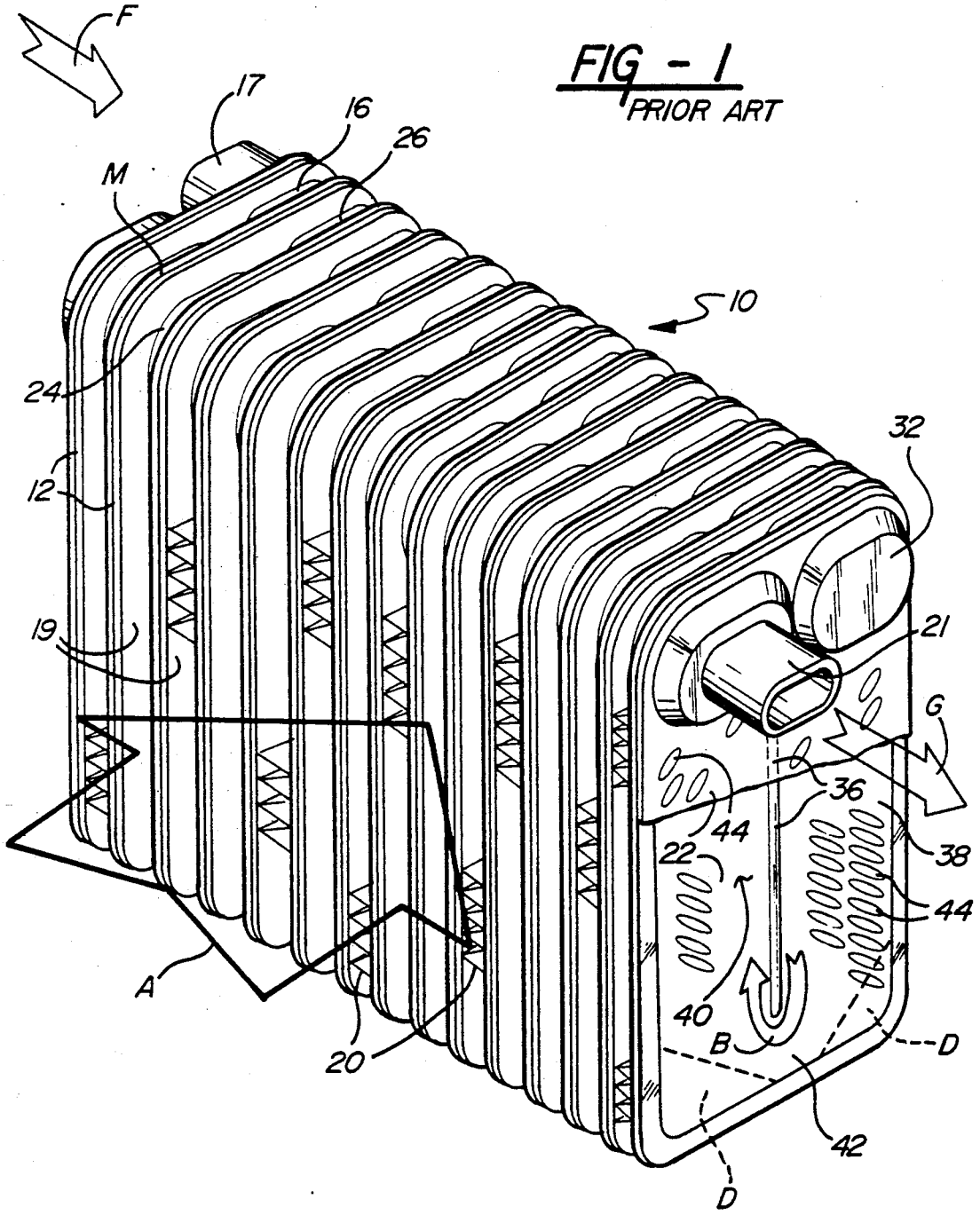
FIG - 1 PRIOR ART
FIG. 1 is a pictorial view of a prior art evaporator having a plurality of tubular fluid passes conducting a refrigerant from an inlet to an outlet.

Turning now in greater detail to the drawings, there is shown in FIG. 1 a finned prior art cross flow heat exchanger 10 in the form of an evaporator core for an automotive air conditioning system adapted to be mounted within a module in the engine passenger compartment of the automobile. The heat exchanger 10 comprises a plurality of generally flattened fluid conducting tubes 12 hydraulically interconnected with one another by projecting side by side upper tank portions 14 and 16 to provide a flow path for the heat exchanger fluid F supplied thereto by way of an intake pipe 17 operatively connected into a first of the tubes 12. The heat exchanger fluid is initially in a liquid phase as it enters into the core of the heat exchanger from the condenser, not shown, and as it courses through the exchanger, the exchanger fluid boils and changes phase from liquid to a gaseous phase. The tubes 12 are physically mounted parallel to one another, and are operatively connected at their upper ends by the tank portions 14 and 16, and are arranged to define spaces 19 therebetween to accommodate air centers or fins 20. These air centers, secured between the flattened body portions of each of the plates, interfaced with one another to define each tube, are corrugated thin sheets of aluminum of other suitable metal and operate to increase the heat transfer performance of the heat exchanger.

In an air conditioner evaporator, a cross flow of air, flow arrow A, forced through the air centers 20 of the heat exchanger by a fan, whose speed and output is under control of vehicle occupants, loses heat energy to the liquified refrigerant circulating internally through the U-flow tubes which boils and vaporizes and is discharged in the gaseous phase G. This vaporized refrigerant is piped through an outlet pipe 21 to a compressor, not shown, which compresses the low pressure refrigerant vapor into a high pressure, high temperature vapor for circulating into a condenser which condenses the vapor into a liquid for delivery back to the evaporator to complete a basic system to cool the interior of the automobile.

Each tube is fabricated from a pair of identical mating plates 22 but which are identified for description purposes as the top plate and bottom plate. Each plate is a flat stamping except that the upper ends have protuberances 24, 26. Each protuberance is formed with an opening, as shown in FIGS. 2A, 2B, with the exception of certain plates that may have blank, such as blank 32 in the right hand end plate to control the course of the fluid flowing through the core.

Adjacent tubes 12 operatively interconnect with one another to transmit heat exchanger fluid from the inlet pipe 17 to the outlet pipe 21. The protuberances, which define the tank portions 14 and 16 are interconnected by a projecting annular collar around an end opening in one protuberance, which closely fits and connects into the opening of the protuberance of the adjacent tube when the tubes are stacked for mechanical interconnection and brazing with one another, as is well known in this art.

As shown in FIG. 1, each core plate 22 has an elongated centralized indented divider rib 36, which is solid and defines side flow sections 38, 40 and crossover section 42 at the bottom of the plates. These plates, when interfaced and joined into tubes, provide for the U-flow construction which has a pattern of smaller indented ribs 44, which when the core plates are interfaced and brazed together provide for optimized mechanical strength and for a tortuous U-flow path, flow arrow B, through each tube for effective transfer of heat energy between the heat exchanger fluid and the ambient air. While such heat exchangers are effective for absorbing heat energy, local dry out areas occur, such as in the lower corners identified by areas D, D of each tube, as illustrated in FIG. 1. With only vapor coursing around the corners away from the centralized divider rib and around the bottom of each tube, transfer efficiency is reduced and efficiency of the heat exchanger is adversely affected.

Figure 2A:
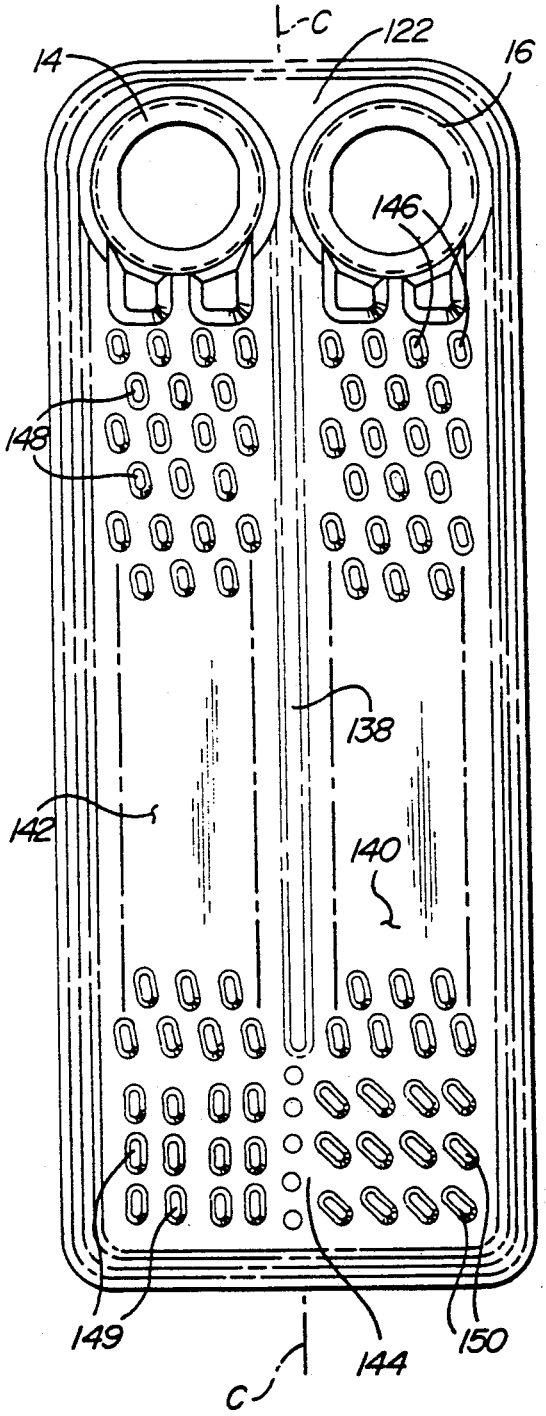
FIGS. 2A and 2B are plan views of a pair of identical plates for making a tube pass which could be employed in place of the tube passes of a heat exchanger, such as those in FIG. 1.
Figure 2B:
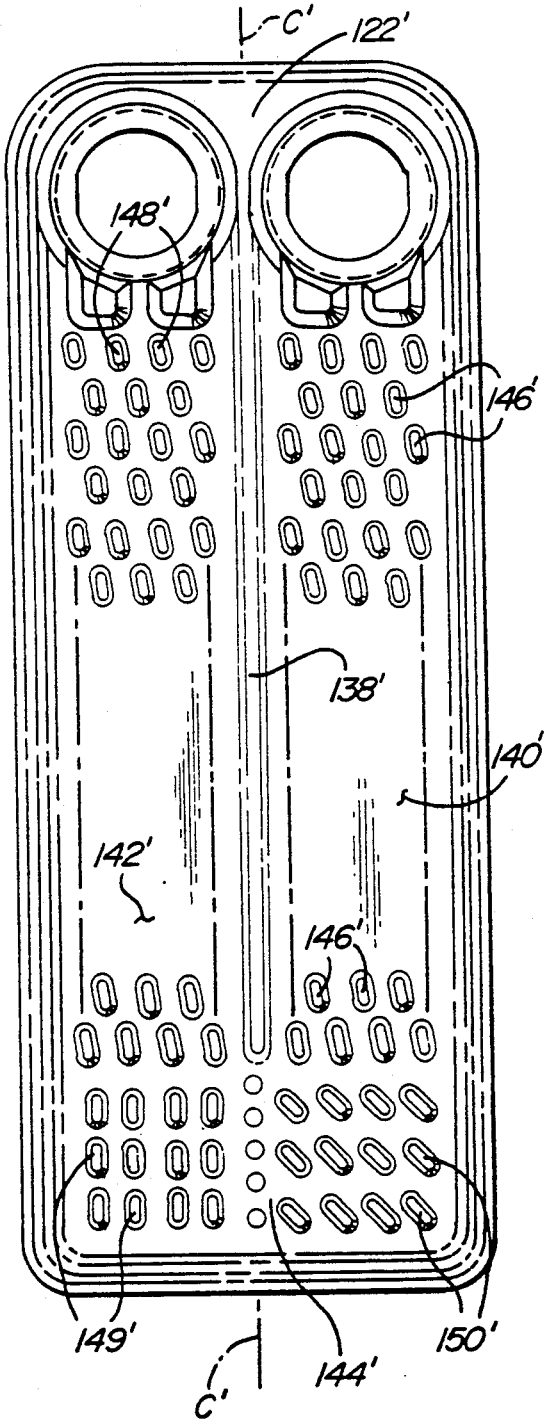

To increase efficiency and effectiveness of the heat exchanger, separate tubes of such multi tube pass heat exchangers 10 can be readily made using identical plates 122, 122', shown in FIGS. 2A, 2B. Each plate is formed with an elongated divider rib 138, 138' which separate the tubes into a U-flow tube with the plate having side flow inlet and outlet sections 142', 140' and 140', 142' interconnected by crossover sections 144, 144'. Each side flow section has elongated rows of oval ribs 146, 148 and 146', 148' the long axes of which are parallel with one another and slightly angled with respect to the divider ribs or centerline C, C' of the respective plates. The lower crossover sections 144, 144' of each plate located below the end of the centralized rib 138, 138', and at the turn of the U-flow, has straight and angularly displaced ribs 148, 150 and 148', 150', respectively, on opposite sides of centerlines C, C'. Ribs 150, 150' are importantly angled toward the outer corners of their respective plates so that when overlapped with ribs 149, 149' a large portion of the fluid flow entering the crossover passage will be directed and distributed to the corners of the tubes.

Figure 3:
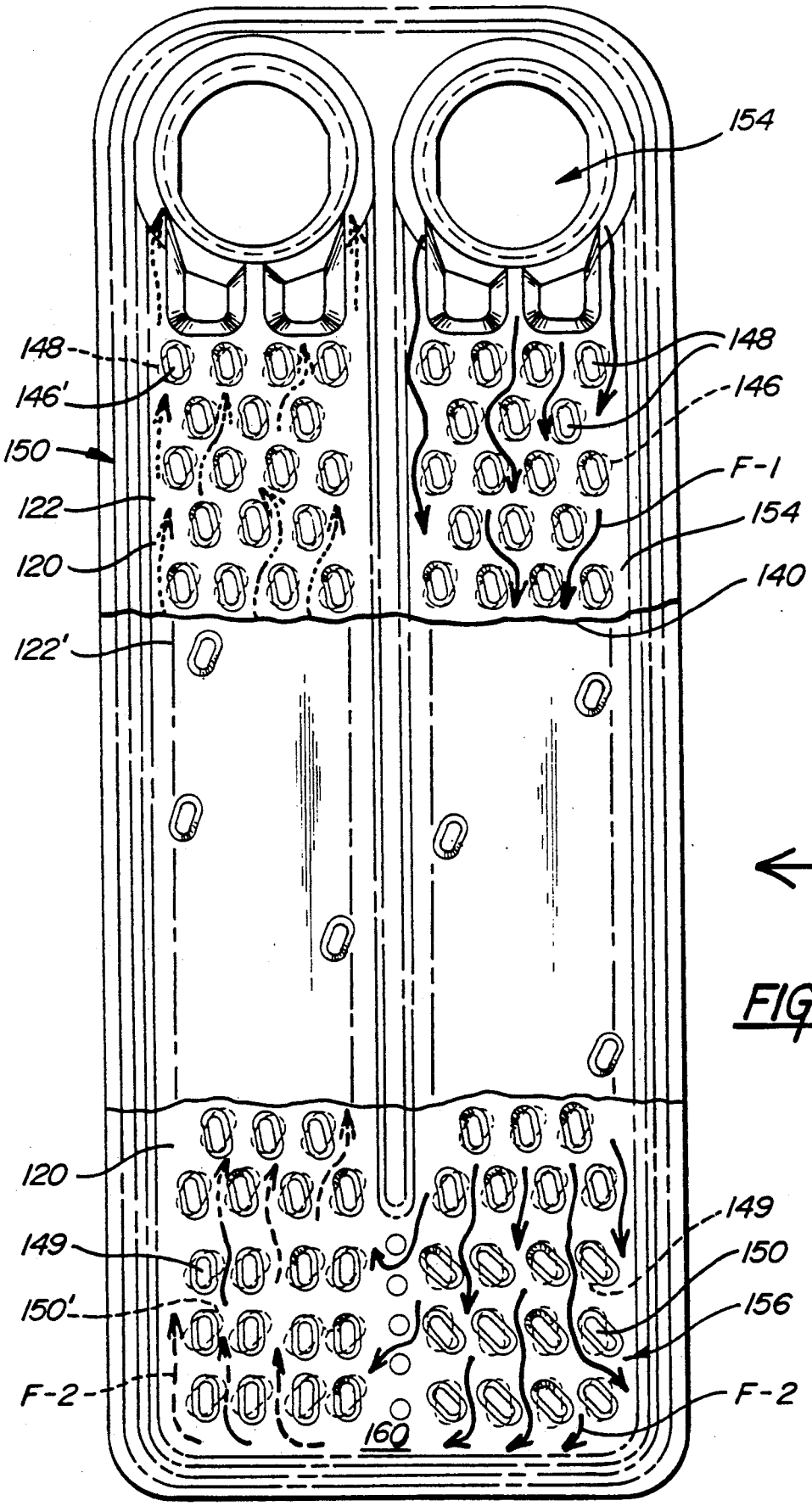
FIG. 3 is a planar view of a tube pass made from mating tubes of FIGS. 2A and 2B which is partly broken away to show details of the plates.

This is best shown in FIG. 3, the plates 122, 122' are interfaced and overlap one another and are operatively connected to form tubes 150 which can be readily used as replacements for tubes 12 of the heat exchanger of FIG. 1.

This arrangement is such that when the heat exchanger fluid is fed into an upper tank 154 through an intake pipe, such as 17 in FIG. 1, the first side flow section 154 in which ribs 148 and 146 are crossed to provide a tortuous flow path, flow arrows F-1, in the first side section. The first section of the tube pass 150 accordingly operates with an optimum heat transfer efficiency. The heat exchanger fluid leaving the first side flow section 154 may be in a partially liquid and partially in a transition phase, i.e., partially liquid and partially vapor.

On entering the crossover section 156 of the tube formed by the mating crossover section 144 and 144', turbulence is increased and directed to the corners of the tube because the inclination of the ribs 150, 150' of the top and bottom plates provide a directed but tortuous flow channels, flow arrows F-2, extending close to and interior of the corners of the tube pass so that the heat transfer efficiency is materially increased. This results in the increased supply of heat exchanger fluid in a liquid state into the crossover section 160.

This invention, accordingly, provides strategically spaced flow zones and paths to enable some of the fluid in the liquid state to flow through some or all zones and areas of each of the tubes until discharged through outlet pipe. This provides an optimized distribution of the liquid refrigerant so that the efficiency of the evaporator as a unit will be materially increased.

As shown best in FIG. 3, the heat exchanger fluid flows through the tubes and the hot air, flow arrow A, such as in the interior of the vehicle passenger compartment, is blown across the outer surfaces of the tubes. Thermal energy of the air is transferred to the refrigerant causing some of the refrigerant to change from a liquid to a gaseous state which expands and exits through the vapor side of the tube. However, since the discrete flow directing sections are provided in this construction, quantities of the refrigerant will remain in the liquid state, heat exchanger fluid, and will be available in the crossover section 160 so that there are no dry out areas, and thereby heat exchanger efficiency is increased.

Figure 4:
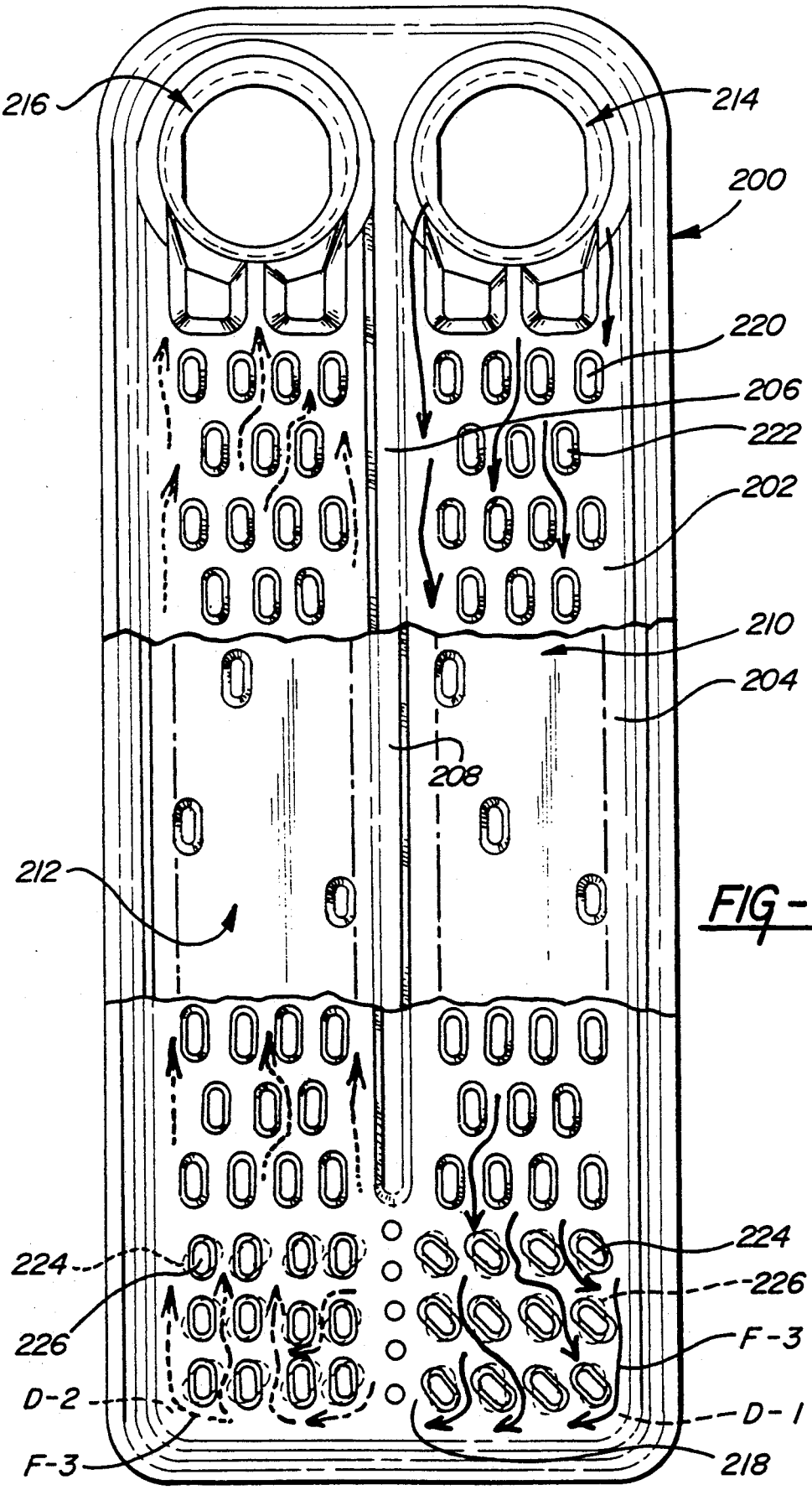
FIG. 4 is a plan view of a tube pass similar to the tube pass of FIG. 3 but with a different arrangement of ribs in the side flow pass to show an alternative embodiment of the invention.

FIG. 4 illustrates another preferred embodiment of this invention by a U-flow tube pass 200, which can be readily used in place of the tube passes 12 of FIG. 1 to provide an evaporator for an air conditioning system. The tube pass 200 has top and bottom plates 202 and 204, each having an indented centralized rib 206 and 20 that interface one another, and when brazed together form a solid rib to separate the elongated inlet side passage 210 and the adjacent outlet side passage 212. The inlet side passage 210 leads from a first upper tank portion 214 while the outlet side passage terminates at a second upper tank portion 216 adjacent to the first tank portion. As in the previous embodiment, the divider rib extends downward through a major portion of the length of the tube pass but terminates short of the bottom of the tube so as to provide a crossover section 218 of the U-flow tube pass.

As shown, the top and bottom plates have rows of indented oval short ribs 220 and 222 that have elongated vertical axes parallel to one another and to the centralized divider rib formed by the indented centralized ribs. The short ribs, when brazed together, may be in rows of three and four ribs spaced from one another, as shown, so that the ribs of one row are offset from the ribs of another row creating a tortuous flow path for the refrigerant as it flows from one side path to the other. As shown, some of the short ribs 224 in the crossover section are crossed with vertical ribs 226 to form director ribs so that some of the refrigerant which is still in liquid stat is directed to the dry out areas which occur in many other designs as shown by flow arrows F-3.

Accordingly, the crossed directional short ribs 224 divert flow containing liquified refrigerant to the corners, which in this case are the lower corners D-1 and D-2, to effect absorption of heat energy present in the air flowing past these areas thereby making the tube pass 200 and the heat exchanger employing these tubes more efficient.

It will be understood that the dry point areas occur in different places, such as in the upper corners, if the heat exchanger were inverted 180 degrees from that shown so that the diverting ribs would be in the crossover passage at the upper end of the tubes instead of the lower end.

With the sections tailoring the flow and improving efficiency of each tube pass, there is improved heat exchange balance throughout all of the tubes comprising the heat exchanger for an improved overall performance of the exchanger.

While the above description constitutes preferred embodiments of the invention, it will be appreciated that the invention can be modified and varied without departing from the scope and fair meaning of the accompanying claims.

I claim:

1. A U-flow tube for conducting vaporizable liquid heat exchanger fluid therethrough for use in a multi tube heat exchanger having an air intake side and air outlet side, each of said tubes having first and second interfacing plates and having an inlet and an outlet for said heat exchanger fluid, each of said plates having an elongated side portions having a divider rib cooperating with one another to define a plurality of discrete side flow sections for conducting said heat exchanger fluid from said inlet to said outlet, each of said plate having a crossover section defining a crossover flow passage operatively interconnecting said side flow sections, and each said crossover section having a rib pattern angled for receiving and directing increased quantities of liquid from said first side flow section to the corners of said crossover section to optimize the transfer of heat form air flowing past said tube.

2. The tube defined in claim 1 above, wherein said crossover section is formed by a series of inclined ribs which route the heat exchanger fluid therethrough the fluid with minimized localized dry out.

3. A heat exchanger having a plurality of flattened tubes operatively interconnected together to provide passage for conducting a volatile heat exchanger fluid therethrough, connector means for interconnecting said tubes so that air can blow between tubes which are adjacent to one another, each of said tubes having a leading edge and a trailing edge and flattened side portion that are laterally spaced from one another, divider rib means in each of said tubes extending to a terminal end therein to define a plurality of discrete side flow section means disposed in each of said tubes, a specialized crossover section for transmitting a portion of said volatile heat exchanger fluid form one side flow section means to the other section means in each of said tubes and flow directing rib means entirely separate from said divider rib means and operatively formed in said crossover section in each of said tubs for directing a portion of said fluid throughout each of said crossover sections so that said heat exchanger has optimized potential for heat transfer by vaporization of said fluid.

4. A tube for use in an evaporator for an air conditioning system comprising a pair of plates interconnected in a face to face relationship, said tube having an inlet and an outlet for fluid refrigerant flow therethrough, said tube further having a centralized divider rib terminating in an end within said tube and defining a plurality of separate side sections in series respectively connected to said inlet and to said outlet, a crossover passage spaced form the end of said divider rib and operatively connecting said side flow sections to one another to provide a passage for said fluid refrigerant flowing therethrough, and discrete fluid flow direction means spaced form said end of said divider rib and operatively formed in said crossover section to direct refrigerant into all areas of said crossover section while at least in a partial liquid state to thereby minimize the area of dry out which may occur in said crossover passage.

* * * * *